United States Patent [19]

Eriksson

[11] 4,001,912

[45] Jan. 11, 1977

[54] VACUUM CLEANER DEVICE

[75] Inventor: Bolik Anders Gottfrid Eriksson, Johanneshov, Sweden

[73] Assignee: Aktiebolaget Electrolux, Stockholm, Sweden

[22] Filed: Jan. 16, 1976

[21] Appl. No.: 649,692

[30] Foreign Application Priority Data

Jan. 31, 1975 Sweden ..... 7501051

[52] U.S. Cl. ..... 15/339; 15/412; 55/DIG. 2; 55/DIG. 3; 55/DIG. 34

[51] Int. Cl.[2] ..... A47L 5/28

[58] Field of Search ..... 15/339, 412; 55/210, 55/DIG. 2, DIG. 3, DIG. 34

[56] References Cited

UNITED STATES PATENTS

| | | | |
|---|---|---|---|
| 2,860,725 | 11/1958 | Cawl et al. | 55/373 X |
| 3,619,850 | 11/1971 | Rideout et al. | 15/412 X |
| 3,676,890 | 7/1972 | Dyer | 15/412 X |

*Primary Examiner*—Christopher K. Moore
*Attorney, Agent, or Firm*—Alfred E. Miller

[57] ABSTRACT

A vacuum cleaner having a device for ensuring that the dust container is in place when it is desired to operate the cleaner. The device constitutes an arrangement on the dust container that functions to close the motor circuit thereby permitting the vacuum cleaner to be operative, however, if no dust container is present in the vacuum cleaner the motor circuit remains open and the vacuum cleaner can not be operated.

7 Claims, 3 Drawing Figures

VACUUM CLEANER DEVICE

BACKGROUND OF THE INVENTION

It is known to provide a construction on a vacuum cleaner which prevents the use of the cleaner without a dust container or bag being in place therein. Such an arrangement is shown and described in Swedish Patent No. 331,168 in which a locking device having a mechanical stop is described. The device functions to prevent the cover for the dust collecting space from being closed when there is no dust container in place in the vacuum cleaner. It should be apparent that such a device requires additional structure both on the cover and in the dust collecting space. This construction increases the manufacturing and assembly cost of the vacuum cleaner.

It is an object of the present invention to simplify the construction and arrangement in a vacuum cleaner which prevents usage of the cleaner without a dust container. The device selected utilizes a part of the attachment plate of a dust container to close the current supply circuit for the vacuum cleaner motor thereby permitting the motor to be operative.

A further object of the present invention is to provide an arrangement for a vacuum cleaner that is not only inexpensive to construct, but is reliably effective for the purposes intended.

In order that the invention will be more clearly understood it will now be disclosed in greater detail with reference to the accompanying drawings, in which: FIG. 1 is a partly sectional and a partly elevational view of a vacuum cleaner embodying the present invention, and showing the dust container in place and the cover closed.

FIG. 2 is a sectional view showing the upper part of the vacuum cleaner illustrated in FIG. 1 and showing the cover during its closing movement, and FIG. 3 is a perspective view of the attachment plate of a dust container or bag.

DESCRIPTION OF THE PREFERRED EMBODIMENT

Figure 1:
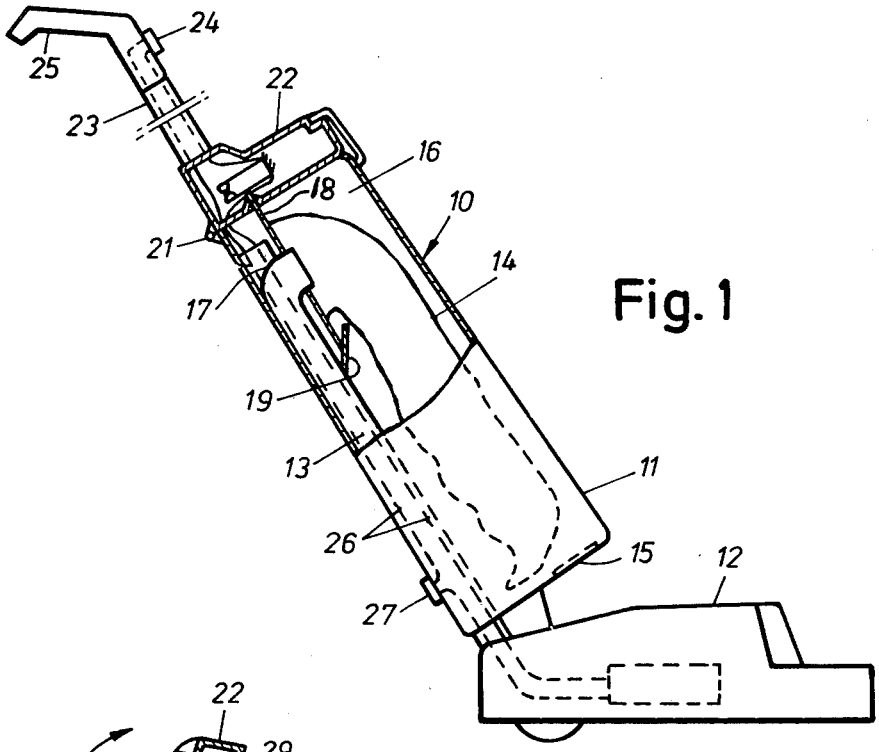

As seen in FIG. 1, the vacuum cleaner apparatus is referred to generally by the numeral 10 and comprises an upper part 11 which is arranged to be pivoted on the lower part 12. The operating elements of a vacuum cleaner are well known which comprise an electric motor that operates a cylinder-shaped brush through a drive belt (not shown). The cylinder brush is positioned in the suction opening of lower part 12 of the vacuum cleaner. The dust laden air conducted through the suction opening is blown through the air channel 13 and into the dust container 14. The air, freed of dust in the dust container, thereafter is blown through the outlet grate 15 in the bottom of part 10 of the vacuum cleaner.

As seen in FIG. 1, the air channel 13 opens into the space 16 by means of the bend 17 at the free end of the channel. The dust container in part 11 is attached to the tube bend 17 by means of the attachment plate 18. It will be observed that a support 19 is located in part 11 for the lower edge of the attachment plate and is arranged below the bend 17, and inside the space 16.

A cover 22 is pivotably connected to the apparatus part 11 by means of a hinge 21 in order to close the same. In the upper part of the cover 22 there is a shaft portion 23 and a connected handle 25 for the operation of the apparatus on the working surface. A switch 24 is shown arranged on the exterior of the shaft 23 of the handle 25. Electric wires 26, schematically shown by dashed lines, feed the electric motor of the apparatus with current from an electrical connection box 27 that is connected to the line current via the switch 24 and a pair of contacts in the cover 22, comprising an upper stationary contact 28 and a lower movable contact 29.

Figure 2:
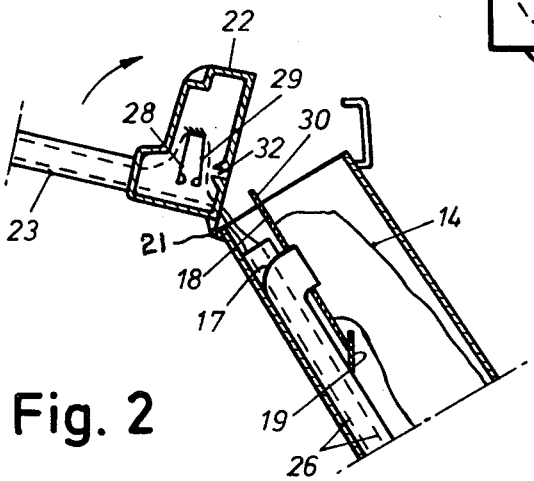
Figure 3:
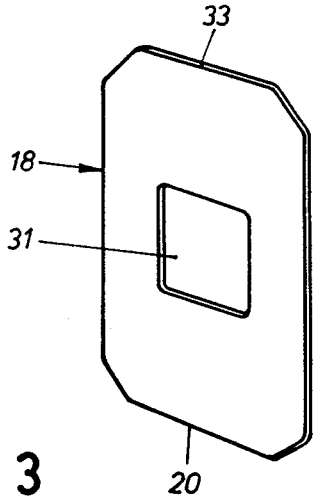

As seen in FIG. 2, the bend 17 of the air channel 13 is arranged in the upper part of the dust collecting space 16 and when the dust container 14 is inserted therein the upper portion 30 of the attachment plate 17 projects somewhat out of the open end of the upper part 11.

The vacuum cleaner device functions in the following way: As shown in FIG. 2, the contacts 28 and 29 are normally separated, however when a dust container is inserted in the part 11 with the free end of the bend 17 pressed into an opening 31 in the attachment plate 18, the upper portion 30 of the attachment plate is located outside the part 11. Thus, when the cover 22 is pivoted to a closing position the upper portion 30 of the attachment plate passes through a slot 32 in the base portion of the cover 22, so that when the cover is closed, and the vacuum cleaner is in its operating configuration, the upper edge 33 of the attachment plate forces the lower movable contact 29 into engagement with the upper contact 28 (FIG. 1). In this manner the circuit to the apparatus motor is closed and the motor is capable of being operated by switch 24.

If, on the other hand, no dust container should be in the apparatus the contacts 28 and 29, after the cover 22 has been closed, would remain separated and the circuit would be broken. In this simple way an indication is obtained by the user that there is no dust container in the apparatus.

Several modifications of the present device may be made within the spirit and scope of the present invention. For example, instead of permitting the movable contact 29 from being acted upon by the upper edge 33 of the attachment plate 18 to close the electrical circuit, the two contacts 28 and 29 can be arranged so that the upper plane surface portion 30 of the attachment plate, after the cover 22 is closed, will cause the movable contact to come into engagement with the stationary contact. Furthermore, the space behind the slot 32 may be insulated in a suitable manner in order to avoid accidential injury due to physical contact with line components of the device.

What is claimed is:

1. In a motor-driven vacuum cleaner having a dust container with an air pervious portion connected to a relatively rigid attachment plate, said plate having an inlet for dust-laden air, a current supply circuit for said motor that is normally open when no dust container is present in said vacuum cleaner, the improvement comprising: a surface of said attachment plate being positioned to close the current supply circuit and render said motor operative when said dust container is inserted in the proper place in said vacuum cleaner, and said vacuum cleaner is in its operating configuration.

2. The combination as claimed in claim 1 wherein at least a part of said attachment plate is formed as an actuating device to close said current supply circuit.

3. The combination as claimed in claim 1 further comprising switch contacts which are acted upon by said surface of the attachment plate, said switch contacts being normally open and urged into a closed position when said dust container is inserted in the proper place in said vacuum cleaner and said vacuum cleaner is in its operating configuration.

4. The combination as claimed in claim 3 wherein said vacuum cleaner includes a housing for said dust container, a movable cover part for said housing, an air channel in said housing communicating said dust container to said motor, and said switch contacts being mounted in said cover whereby when said cover is in a closed position on said housing said surface of the attachment plate engages at least one of said switches to move said switch into engagement with the other switch and thereby close said circuit.

5. The combination as claimed in claim 4 wherein said cover is pivotally hinged to an upper part of said housing.

6. The combination as claimed in claim 4 wherein the lower switch is movable and the upper switch is fixed, and a projecting part of said attachment plate is so constructed and arranged as to urge the lower switch against said upper switch when said dust container is in the proper place in the vacuum cleaner.

7. The combination as claimed in claim 6 wherein said cover is provided with a base portion that has a slot through which the projecting part of said attachment plate protrudes when the cover is in the closed position to engage said lower switch and move the same into engagement with said fixed upper switch.

* * * * *